US005688219A

United States Patent [19]

Renard et al.

[11] Patent Number: 5,688,219

[45] Date of Patent: Nov. 18, 1997

[54] DEVICE FOR TRANSPORTING COPIES INSIDE A FOLDER EQUIPPED WITH A CUTTING CYLINDER

[75] Inventors: René Renard, Montigny les Cormeilles; Guy Loquet, Liancourt; Frank Bausela, Creil, all of France

[73] Assignees: Heidelberger Druckmaschinen AG, Heidelberg, Germany; Heidelberg Harris SA, Montataire Cedex, France

[21] Appl. No.: 608,777

[22] Filed: Mar. 7, 1996

[30] Foreign Application Priority Data

Mar. 7, 1995 [FR] France ..... 95 02626

[51] Int. Cl.[6] ..... B65H 5/02; B31B 1/14

[52] U.S. Cl. ..... 493/357; 271/273; 271/275; 271/198; 198/804; 198/817

[58] Field of Search ..... 271/272–274, 271/198, 188, 314, 275; 198/804, 817; 403/322, 354; 192/69, 85 C, 85 CA; 493/357, 358, 359, 360, 436

[56] References Cited

U.S. PATENT DOCUMENTS

| | | | |
|---|---|---|---|
| 1,173,704 | 2/1916 | Blanchard | 403/354 X |
| 2,783,043 | 2/1957 | Tomlin | 271/188 |
| 2,937,042 | 5/1960 | Wilder, Jr. | 403/354 |
| 3,334,892 | 8/1967 | Janecek et al. | 271/314 |
| 3,756,589 | 9/1973 | Carbine | 271/274 |
| 4,279,410 | 7/1981 | Bolza-Schuenemann . | |
| 4,344,610 | 8/1982 | Jeschke et al. . | |
| 4,375,194 | 3/1983 | Rohrbach | 192/85 C X |
| 4,482,039 | 11/1984 | Harris | 192/85 CA X |
| 4,511,028 | 4/1985 | Meister | 198/817 X |
| 4,564,470 | 1/1986 | Schmitt . | |
| 4,746,107 | 5/1988 | Schneider et al. . | |
| 4,872,661 | 10/1989 | Knepper | 271/273 |
| 5,022,645 | 6/1991 | Green | 271/273 X |
| 5,213,322 | 5/1993 | Matsuo et al. | 271/198 X |
| 5,292,113 | 3/1994 | Morigami et al. . | |
| 5,433,431 | 7/1995 | Lowell | 271/198 X |

FOREIGN PATENT DOCUMENTS

| | | | |
|---|---|---|---|
| 73 02110 | 9/1973 | France . | |
| 73126 | 4/1985 | Japan | 192/85 C |
| 235308 | 10/1986 | Japan | 198/804 |
| 94/16413 | 7/1994 | WIPO . | |

OTHER PUBLICATIONS

Cotta Transmission, "Coupling Permits Quick Shaft Disconnect", Design News –Oct. 15, 1957.

*Primary Examiner*—Boris Milef
*Attorney, Agent, or Firm*—Herbert L. Lerner; Laurence A. Greenberg

[57] ABSTRACT

Device for transporting copies inside a folder which is equipped with at least one cutting cylinder for cutting individual copies from a web, the copies being transportable from the cutting cylinder to at least one copy-guiding component, and groups of tapes for transporting the copies being associated with the cutting cylinder and the copy-guiding component, includes deflector members for the groups of tapes and the at least one copy-guiding component, the deflector members having opposite ends at which the deflector members are supportingly engaged, and adjusting members for disengaging one of the ends of the respective deflector members.

9 Claims, 4 Drawing Sheets

DEVICE FOR TRANSPORTING COPIES INSIDE A FOLDER EQUIPPED WITH A CUTTING CYLINDER

BACKGROUND OF THE INVENTION

Field of the Invention

The invention relates to a device for transporting copies inside a folding apparatus or folder equipped with at least one cutting cylinder, which cuts individual copies from a web of paper, the copies being then conveyed to at least one copy-guiding cylinder, groups of tapes for transporting the copies being assigned to the respective cutting cylinder and to the respective copy-guiding cylinder.

Numerous variations of folding apparatuses or folders wherein more or less high-speed groups of transport tapes are installed are known in the prior art. U.S. Pat. Nos. 4,279,410 and 4,344,610, for example, disclose folding apparatuses or folders wherein copies cut from a web are transported by groups of parallel tapes either to a delivery or to further processing cylinders. In the foregoing U.S. patents, folding apparatuses or folders are disclosed wherein the individual severed copies are transported from copy-guiding cylinders to a further processing location, such as a second longitudinal folding device, for example, via groups of parallel transport tapes, which secure the thus-conveyed copies at both sides thereof.

It has been found that, in folding apparatuses or folders which are provided with a number of transport tapes disposed side by side, it may be necessary to change these tapes. Tensioning devices which are capable of keeping the individual transport tapes under a defined tension can compensate for the elongations and extensions, i.e., the stretching, of the individual transport tapes after a given period of use. When the elongations exceed a given value, however, replacement of the one or more tapes which may be involved cannot be avoided. It is then necessary to open the part of the folding apparatus or folder in which the cylinders are disposed, in order to remove the worn tape or tapes and to install new ones in their place. This entails a considerable amount of standstill or off-line time for the folding apparatus or folder, a diversion of the output of a running rotary press to a neighboring folding apparatus or folder, if one is available, being necessary and, on the one hand, it may then be necessary to reduce the speed and, on the other hand, again to separate or sever the diverted copies from other copies. All in all, a tape change in the folding apparatus or folder causes a capacity bottleneck which is sought to be removed as soon as possible.

SUMMARY OF THE INVENTION

It is accordingly an object of the invention to provide a device for transporting copies wherein the changing of transport tapes in a folding apparatus or folder thereof is simplified in order to reduce the standstill or off-line time therefor to a minimum.

With the foregoing and other objects in view, there is provided, in accordance with the invention, a device for transporting copies inside a folder which is equipped with at least one cutting cylinder for cutting individual copies from a web, the copies being transportable from the cutting cylinder to at least one copy-guiding component, and groups of tapes for transporting the copies being associated with the cutting cylinder and the copy-guiding component, comprising deflector members for the groups of tapes and the at least one copy-guiding component, the deflector members having opposite ends at which the deflector members are supportingly engaged, and adjusting members for disengaging one of the ends of the respective deflector members.

In accordance with another feature of the invention, the device includes adjusting pins movable by the adjusting members in an axial direction.

In accordance with a further feature of the invention, the device includes a side wall, bushings fixed to the side wall, the adjusting members being integrated in the bushings.

In accordance with an added feature of the invention, the folder has a side wall, and the adjusting members are mounted directly on the side wall.

In accordance with an additional feature of the invention, the adjusting pins have a form-locking connection with at least one of the disengageable ends of the deflector members and the at least one copy-guiding component. In this regard, it is noted that a form-locking connection connects two elements together due to the shape of the elements themselves, as opposed to a force-locking connection, which locks the elements together by the application of a force external to the elements.

In accordance with yet another feature of the invention, the respective groups of tapes have at least one tensioning device.

In accordance with yet a-further feature of the invention, the adjusting members include an axially displaceable protective part.

In accordance with yet an added feature of the invention, the adjusting members are formed as pneumatic cylinders.

In accordance with a first alternative feature of the invention, the adjusting members are formed as hydraulic cylinders.

In accordance with a second alternative feature of the invention, the adjusting members are formed as electric motors.

Thus, multiple advantages result from the invention of the instant application. The ends of deflector members or copy-guiding components are accordingly disengageable by a use of adjusting members. In this regard, a disengagement of one deflector member after another may take place, as well as a disengagement in common of the ends of several deflector members or copy-guiding components is possible. Thereafter, the worn transport tapes can be removed laterally from the deflector rollers when the tensioning devices are relieved or deactivated. When the tensioning devices are in the tension-relieved or deactivated condition thereof, the mounting or installation of new transport tapes is considerably facilitated, before the adjusting members again fix the disengaged ends of the deflector members and the copy-guiding components in position.

In a further embodiment of the inventive concept, the adjusting members move adjusting pins in an axial direction. In this regard, the adjusting members can both be integrated in bushings or sleeves which are secured to a side wall of the folder, as well as be mounted directly on or in the side wall of the folder. By means of the axially movable adjusting pins, a form-locking connection with disengageable ends of the deflector members and the copy-guiding components can be produced and again nullified. To facilitate the disassembly of individual tapes or entire groups of tapes, tensioning devices are integrated into the groups of tapes for maintaining the tape tension during operation and for compensating for stretching or elongation of the tapes after a relatively lengthy operating period. During the disassembly, these tensioning devices are relieved of tension or deactivated, so that when the ends of the deflector members and the copy-guiding components are disengaged, the tapes can be simply pulled off.

The adjusting or control members are formed either as pneumatic cylinders or jacks or hydraulic cylinders or jacks. It is also conceivable that the adjusting or control members have an electromotive construction, so that the adjusting pins can be axially moved either directly or by means of step-up or step-down transmission gears. The tensioning devices are returned to operative tension after the assembly or mounting of new transport tapes, in order that the latter be again placed under operative tension.

Other features which are considered as characteristic for the invention are set forth in the appended claims.

Although the invention is illustrated and described herein as embodied in a device for transporting copies, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
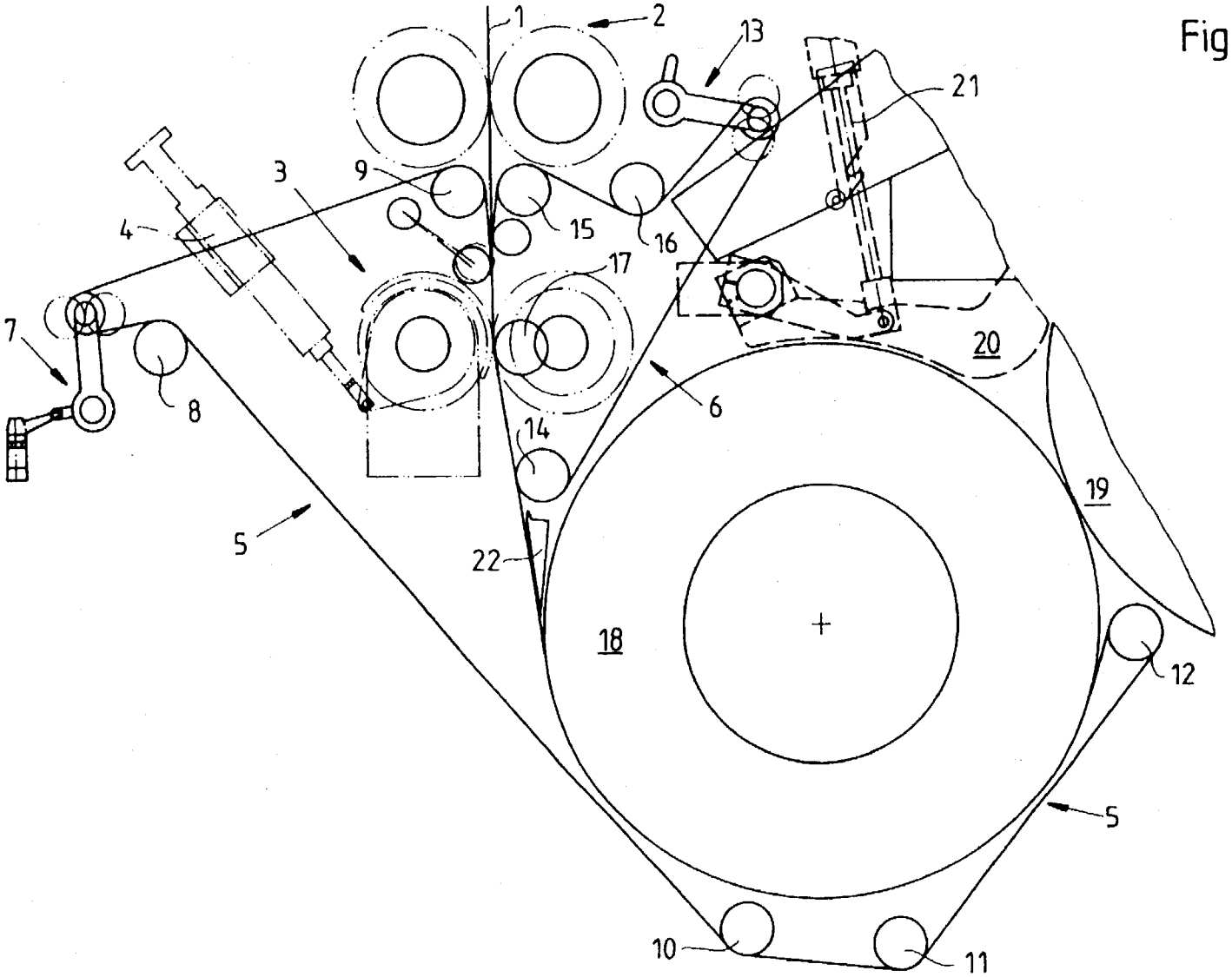
FIG. 1 is a diagrammatic side elevational view of two groups of tapes extending from a cutting-cylinder pair to a cylinder for guiding copies.

Referring now to the drawings and, first, particularly to FIG. 1 thereof, there are represented therein two groups of copy transport tapes in a folding apparatus or folder.

The copies are cyclically separated or cut from a web 1 of paper or corresponding material which enters vertically between the two cutting cylinders of a cutting-cylinder pair 2. Groups 5 and 6 of parallel tapes or belts take over or accept the copies thus formed. A deforming unit 3 which can be set into operation by control members 4 is integrated in the transport path of the groups of tapes 5 and 6, respectively.

A first group 5 of tapes passes over deflector members 8, 9, 10, 11 and 12. At least one tensioning device 7 is, moreover, associated with or assigned to the group of tapes 5, maintains the respective tapes under tension when they are in operation, and can be deactivated for disassembling the respective tapes. One of the ends, respectively, of the deflector members 8, 9, 10, 11 and 12 and of the product or copy-guiding component 18, whether it be a folding cylinder or a disc-like component, is disengageable so that, after the tensioning device 7 has been deactivated, the tapes of the group 5 thereof can be Withdrawn perpendicularly to the plane of the drawing and can be replaced by new tapes.

A tensioning device 13 is likewise associated with a second group 6 of the tapes which pass over deflector members 14, 15, 16 and 17. A wedge-shaped guide 22, which is provided below the group 6 of tapes, covers or bridges over the space or gap located under the latter and terminates at the casing or outer cylindrical surface of a copy-guiding component 18, for example, a folding cylinder. One of the ends of the respective deflector members 14, 15, 16 and 17 is disengageable in a manner similar to that noted hereinabove, in order to facilitate replacement or changing of the tapes.

Figure 2:
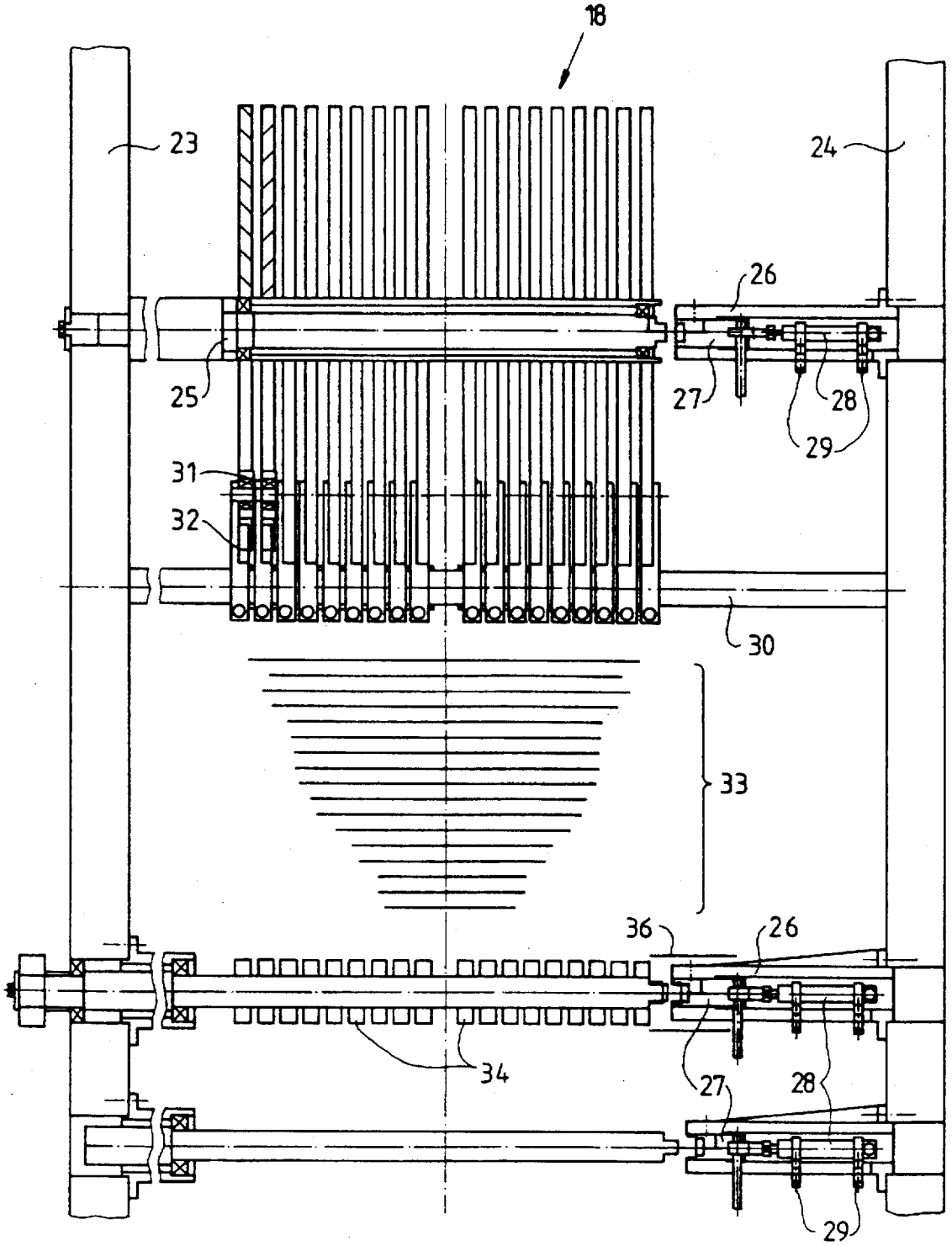
FIG. 2 is a diagrammatic front elevational view of deflecting members and copy-guiding components, one end of which is freely seated by means of adjusting pins displaceable in bushings.

FIG. 2 is a plan view of components located inside a folding apparatus or folder and mounted between two side walls.

Figure 3:
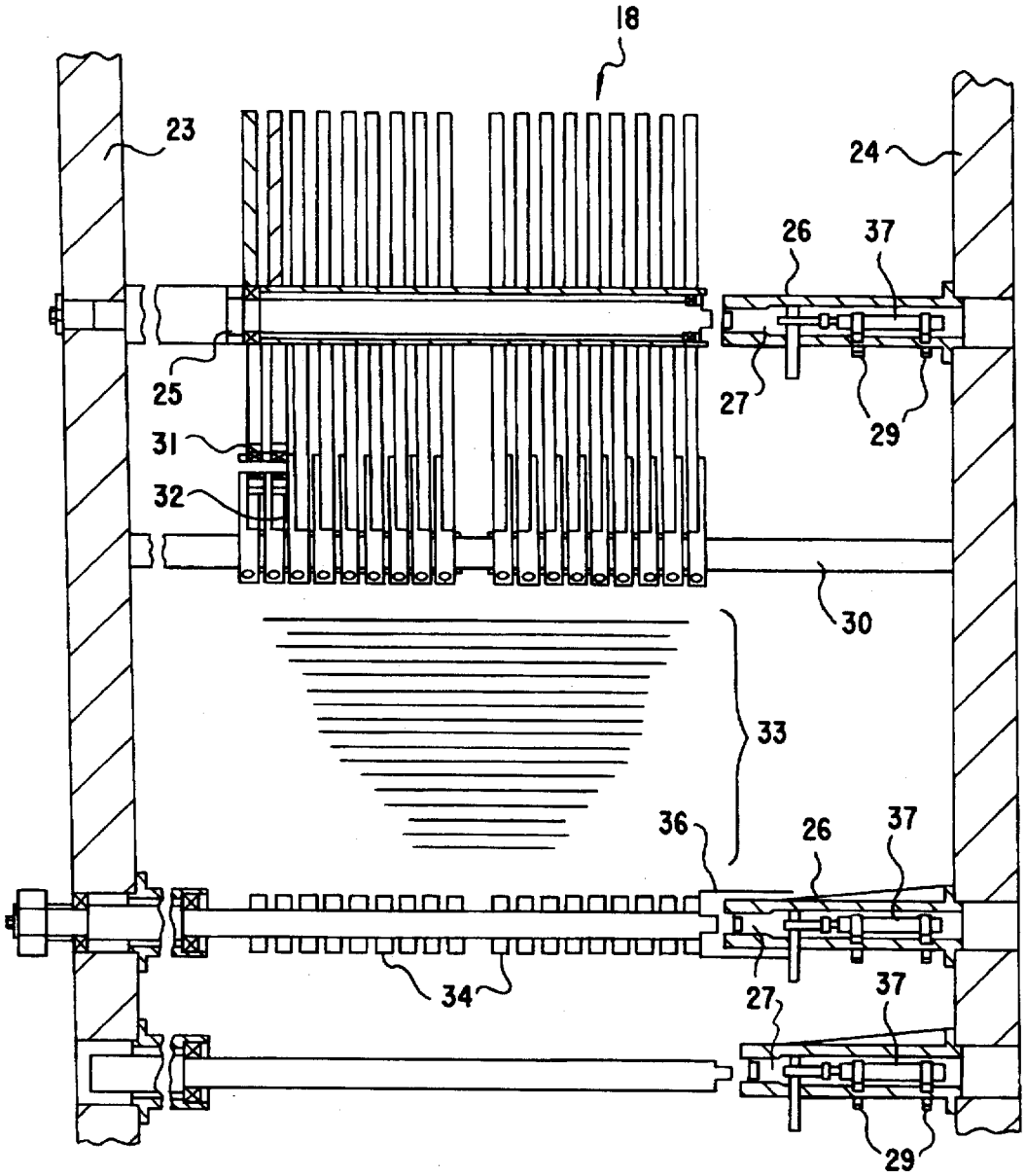
FIG. 3 is a front elevational view of deflecting members and copy-guiding components, one end of which is freely seated by means of hydraulically controlled adjusting pins displaced in bushings.
Figure 4:
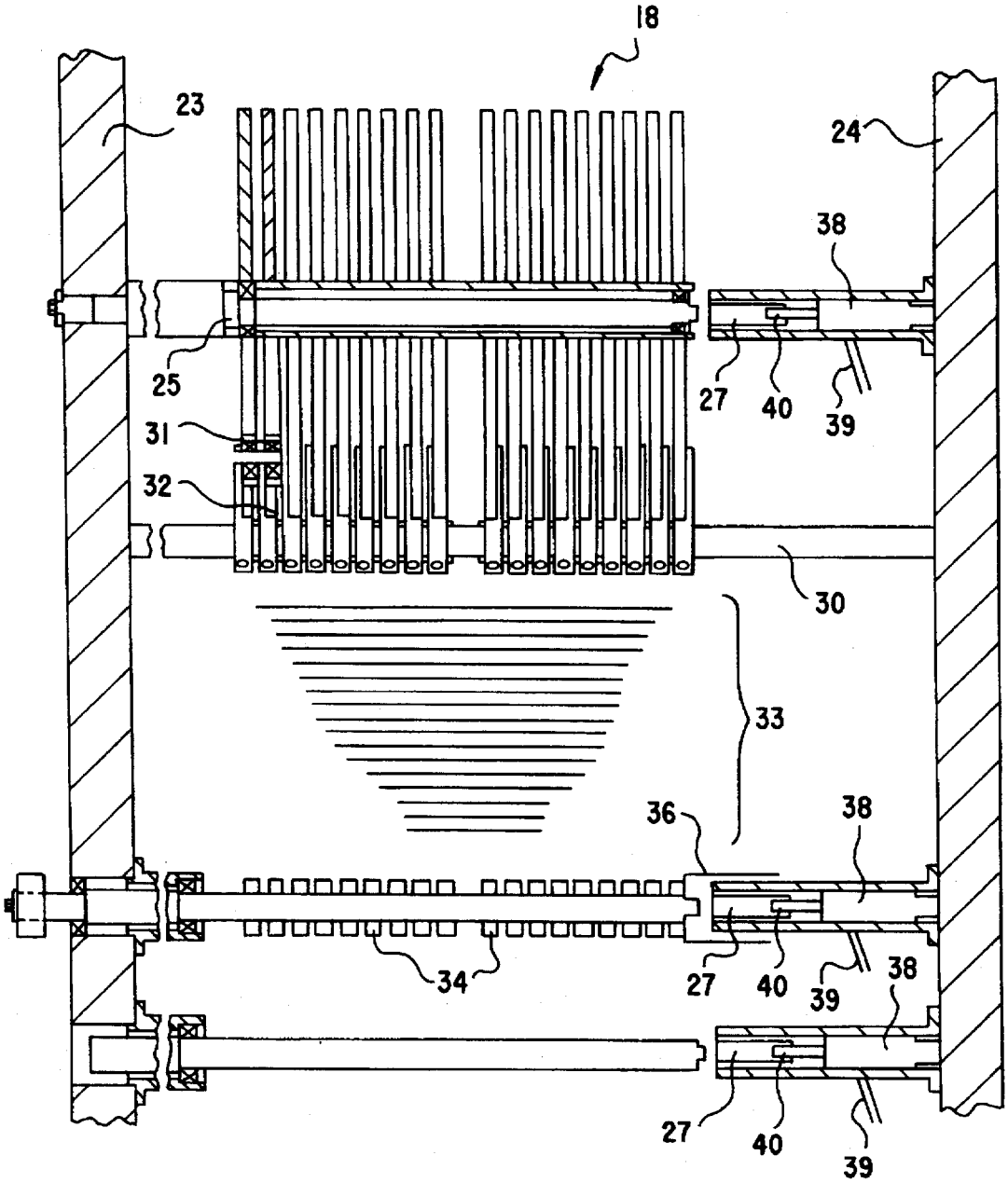
FIG. 4 is a front elevational view of deflecting members and copy-guiding components, one end of which is freely seated by means of electrically controlled adjusting pins displaced in bushings.

Substituted for the components illustrated in FIG. 1 and omitted in the interest of simplicity from FIG. 2 is a shaft 25 of a copy-guiding component 18, as well as two deflector members, one of which carries tape rollers 34. Whereas respective ends of the just-mentioned components are fixedly mounted in a side wall 23, respective opposite ends thereof, which face the side wall 24, can be disposed so as to be disengageable. For this purpose, for example, bushings or sleeves 26 are mounted in the side wall 24 coaxially with the shaft 25. Adjusting or control members 28 are housed in the sleeves 26 and are equipped with connectors 29. The adjusting members 28 actuate an adjusting pin 27 inside the sleeve 26, respectively, in an axial direction. The respective adjusting pin 27 travels either fully into the respective bushing or sleeve 26, or is fully extended therefrom. In the extended or outwardly driven position, a form-locking connection is produced between the end of the shaft 25 facing towards the side wall 24 and the adjusting pin 27. When this adjustable pin 27, conversely, is set back from the end of the shaft 25, the tapes of the first group 5 thereof shown in FIG. 1, which are partially tangent to the circumference of the copy-guiding component 18, can be removed in a relatively simple manner. As shown in FIG. 2, the lower control or adjusting member 28 includes an axially removable protection part 36. This protection part 36 may, for example, be a bellows, and is retracted by the operator before setting back the adjusting pin 27 from the shaft end 25 as described hereinbefore. It is believed to be readily apparent that the arrangement may be identical in the case of the ends of the deflector members 8, 9, 10, 11 and 12 of the first group 5 of tapes and in the case of the ends of the deflector members 14, 15, 16 and 17 of the second group 6 of tapes, which face the side wall 24. In the embodiment described herein, the control or adjusting members 28 are formed as pneumatic cylinders. It is also conceivable to construct the control or adjusting members 28 as hydraulic elements. FIG. 3 shows the adjusting member 28 being formed hydraulic cylinders 37. Also an electromotorized construction of the control or adjusting members 28 would be conceivable, wherein the adjusting pins 27 would be movable in an axial direction by means of a worm drive. FIG. 4 shows the adjusting members 28 being formed from electric motors 38 with supplies 39. The adjusting or positioning movement could also be influenced by the interposition of a gear rack or the like.

In FIG. 2, above the copy-guiding component 18, a stationary shaft 30 is provided, which is equipped with pretensioning levers 32, each of which carries a pretensioning roller 31. The stationary shaft 30 is arranged so that it is located out of the path of the groups 5 and 6 of tapes and therefore does not hinder the replacement of the latter.

It should further be mentioned that the reference numeral 33 denotes the various widths of the copies which can be processed in a folding apparatus or folder. As is readily apparent, the narrowest copy would rest only on the six tapes located at the center of the tape groups 5 and 6, while the folded copy having the maximum possible format would occupy the entire width of the tape groups.

We claim:

1. In combination with a folder which is equipped with at least one cutting cylinder for cutting individual copies from a web, the copies being transportable from the cutting cylinder to at least one copy-guiding component, and groups of tapes for transporting the copies being associated with the cutting cylinder and the copy-guiding component, a device for transporting copies inside the folder, comprising deflector members for the groups of tapes and the at least one copy-guiding component, said deflector members having opposite ends at which said deflector members are supportingly engaged, and adjusting members having adjusting pins movable by said adjusting members in an axial direction for engaging and disengaging one of said ends of the respective deflector members to facilitate a replacement of the groups of tapes.

2. Device according to claim 1, including a side wall, bushings fixed to said side wall, said adjusting members being integrated in said bushings.

3. Device according to claim 1, wherein the folder has a side wall, and said adjusting members are mounted directly on said side wall.

4. Device according to claim 1, wherein said adjusting pins have a form-locking connection with at least one of said disengageable ends of said deflector members and said at least one copy-guiding component.

5. Device according to claim 1, wherein said respective groups of tapes have at least one tensioning device.

6. Device according to claim 1, wherein said adjusting members include an axially displaceable protective part.

7. Device according to claim 1, wherein said adjusting members are pneumatic cylinders.

8. Device according to claim 1, wherein said adjusting members are hydraulic cylinders.

9. Device according to claim 1, wherein said adjusting members are electric motors.

* * * * *